US007236073B2

(12) United States Patent
Matsutani et al.

(10) Patent No.: US 7,236,073 B2
(45) Date of Patent: Jun. 26, 2007

(54) INDUCTANCE PART AND ELECTRONIC APPARATUS THEREWITH

(75) Inventors: Nobuya Matsutani, Katano (JP); Tsunetsugu Imanishi, Hirakata (JP); Hidenori Uematsu, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 110 days.

(21) Appl. No.: 10/862,360

(22) Filed: Jun. 8, 2004

(65) Prior Publication Data

US 2004/0246090 A1 Dec. 9, 2004

(30) Foreign Application Priority Data

Jun. 9, 2003 (JP) ..... 2003-163611

(51) Int. Cl.
*H01F 27/32* (2006.01)

(52) U.S. Cl. ..... 336/84 R

(58) Field of Classification Search ..... 336/65, 336/83, 192, 200, 206–208, 232, 84 R, 84 C, 336/84 M See application file for complete search history.

(56) References Cited

U.S. PATENT DOCUMENTS

| | | | | |
|---|---|---|---|---|
| 5,598,136 | A * | 1/1997 | Kano et al. | 336/200 |
| 6,198,375 | B1 * | 3/2001 | Shafer | 336/225 |
| 6,501,364 | B1 * | 12/2002 | Hui et al. | 336/200 |
| 6,882,261 | B2 * | 4/2005 | Moro et al. | 336/200 |

FOREIGN PATENT DOCUMENTS

| | | |
|---|---|---|
| JP | 2000-82623 | 3/2000 |

* cited by examiner

*Primary Examiner*—Tuyen T. Nguyen
(74) *Attorney, Agent, or Firm*—Wenderoth, Lind & Ponack, L.L.P.

(57) ABSTRACT

An inductance part is provided which includes: a coil which is formed by bending a metal plate into a coil shape; a magnetic body in which the coil is buried; and a short ring which faces the coil.

13 Claims, 9 Drawing Sheets

INDUCTANCE PART AND ELECTRONIC APPARATUS THEREWITH

BACKGROUND OF THE INVENTION

1. Field of the Invention

The present invention relates to an inductance part which is provided with a short ring, and an electronic apparatus therewith.

2. Description of the Related Art

A CPU which is mounted in an electronic apparatus such as a notebook personal computer is generally operated, using a switching-type power supply circuit such as an AC/DC converter. This power supply circuit is configured by combining an inductance part such as a choke coil, a switching device, and the like.

In recent years, an LSI such as a CPU has been processing data at higher speed, and an LSI itself has been increasingly integrated. This has also raised demands for heightening the frequency of the above described power supply circuit and increasing its electric current. Therefore, an inductance part which is mounted on the power supply circuit has also been required to supply a large quantity of electric current from several to dozens of amperes within a high-frequency range. In addition, an electronic apparatus has recently become smaller and thinner, thus demanding that an inductance part be made smaller and with a thinner profile.

As described above, if a power supply circuit is operated at a high frequency and at a large quantity of electric current, a magnetic flux leaks from an inductance part when an electric current is passed through the power supply circuit. This leakage magnetic flux may cause a peripheral circuit or apparatus, such as a CPU, to generate a high-frequency noise. As a result, operation of the circuit or apparatus may be adversely affected. This presents a demand that such a magnetic flux which leaks from an inductance part be reduced as much as possible.

Accordingly, as a conventional inductance part, for example, a coiled-wire part for a power source is disclosed, as shown in FIG. 15, in Japanese Patent Laid-Open No. 2000-82623 specification. In the coiled-wire part for a power source shown in FIG. 15, a drum core 101 is attached to a terminal stand 104. Around the drum core 101, a coiled wire 102 is wound, and a pot core 103 covers the drum core 101. In the drum core 101, an opening portion is formed which is used to pull out the coiled wire 102. A gutter is formed in the terminal stand 104, and in this gutter, a conductor 105 is placed which is shaped like a coiled wire or a loop.

In recent years, however, there has been a great demand for making the size of such a part smaller, its frequency higher, and the volume of its electric current greater. To meet this demand, the above described coiled-wire part for a power source needs to be operated at a high frequency and at a large quantity of electric current. In that case, a leakage magnetic flux cannot be sufficiently kept from increasing. This disadvantage becomes conspicuous, especially, in a thin and low inductance part whose thickness h does not balance with a setting area S (e.g., $h/(S^{1/2}) \leqq 1/2$). A leakage magnetic flux increases in its thickness direction, thereby having a bad influence on apparatus around it.

Aiming at reducing such a leakage magnetic flux, the conductor 105 which is shaped like a coiled wire or a loop is disposed in the gutter. However, the pot core 103 is opened, and thus, a magnetic flux leaks out in the opened part. In addition, the coil is formed by the coiled wire 102. Therefore, if the coiled-wire part is used within a high-frequency range, it is impossible to operate at a large quantity of electric current while keeping a sufficient inductance value and a low direct-current resistance value.

SUMMARY OF THE INVENTION

It is an object of the present invention to provide an inductance part which is capable of reducing a leakage magnetic flux, and operating at a high frequency and at a large quantity of electric current, and provide an electronic apparatus therewith.

An inductance part according to an aspect of the present invention includes: a coil which is formed by bending a metal plate into a coil shape; a magnetic body in which the coil is buried; and a short ring which faces the coil.

In this inductance part, the coil is covered in the magnetic body, and the short ring is in a position opposite to the coil, thereby reducing a leakage magnetic flux. In addition, the coil is formed by bending a metal plate, not by winding a wire. This allows the inductance part to operate at a high frequency and at a large quantity of electric current.

An electronic apparatus, according to another aspect of the present invention, comprising an inductance part which includes: a coil which is formed by bending a metal plate into a coil shape; a magnetic body in which the coil is buried; and a short ring which faces the coil.

In this electronic apparatus, the inductance part placed therein reduces a leakage magnetic flux and operates at a high frequency and at a large quantity of electric current. Therefore, an electronic apparatus can be realized whose size is small and which operates at a high frequency and at a large quantity of electric current.

These and other objects, features and advantages of the present invention will become more apparent upon reading of the following detailed description along with the accompanied drawings.

DETAILED DESCRIPTION OF THE INVENTION

Hereinafter, each embodiment of the present invention will be described with reference to the drawings.

First Embodiment

Figure 1:
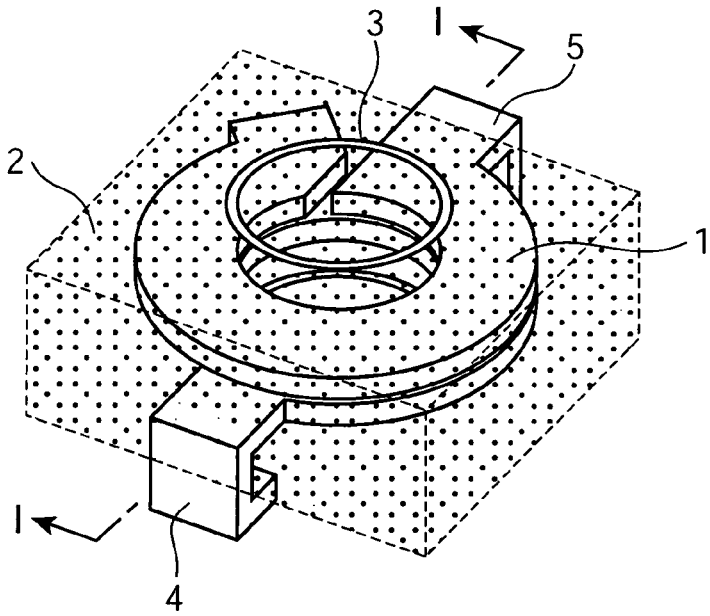
FIG. 1 is a perspective view of an inductance part according to a first embodiment of the present invention.
Figure 2:
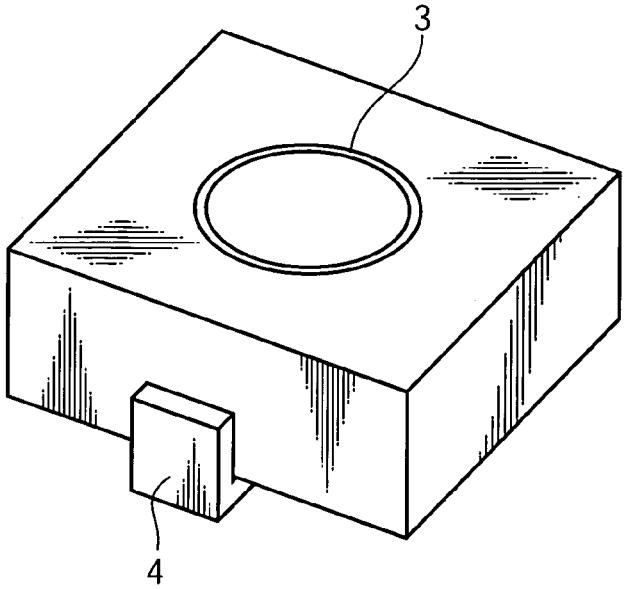
FIG. 2 is a perspective view of the inductance part shown in FIG. 1.
Figure 3:
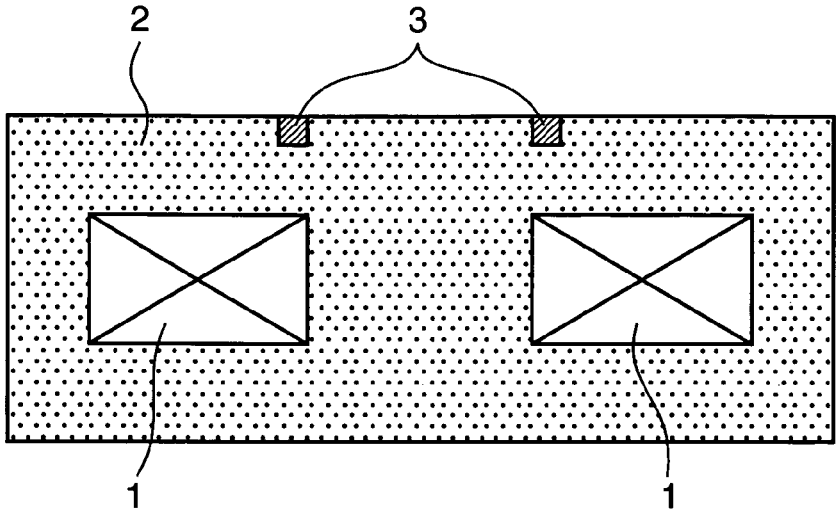
FIG. 3 is a schematic sectional view of the inductance part shown in FIG. 1.

FIG. 1 is a perspective view of an inductance part according to a first embodiment of the present invention. FIG. 2 is a perspective view of the inductance part shown in FIG. 1. FIG. 3 is a schematic sectional view of the inductance part shown in FIG. 1.

The inductance part shown in FIG. 1 to FIG. 3 is a multiple choke coil, and includes a coil 1, a magnetic body 2, a short ring 3, an input terminal 4, and an output terminal 5.

The coil 1 is a non-wire wound coil, and is a sheet-metal member which is formed by bending a metal plate into a coil shape (or substantially spiral shape). Specifically, the metal plate is stamped out to become a predetermined shape, and then, is bent into the shape of the coil 1. The input terminal 4 and the output terminal 5 are united therewith. The coil 1 is buried in the magnetic body 2 which is a core. The input terminal 4 and the output terminal 5 protrude from the magnetic body 2.

The short ring 3 is located so as to face the coil 1 and in the in-plane direction of the magnetic body 2. It is formed concentrically with the coil 1 in the upper surface of the magnetic body 2. As shown in FIG. 3, the short ring 3 is disposed in the upper part of the magnetic body 2, so that its upper surface is located on the same level with the upper surface of the magnetic body 2.

Figure 4:
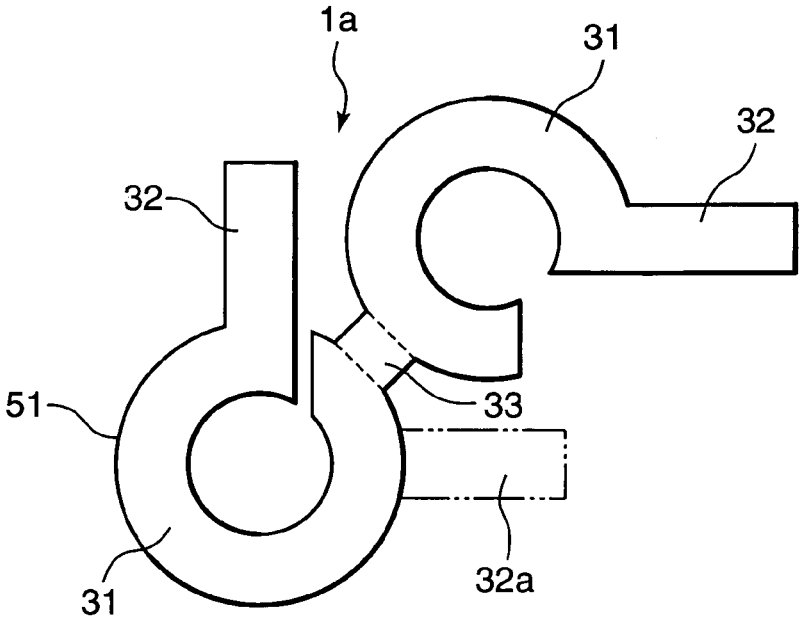
FIG. 4 is a plan view of a coil used in the inductance part shown in FIG. 1, showing a state before it is bent.
Figure 5:
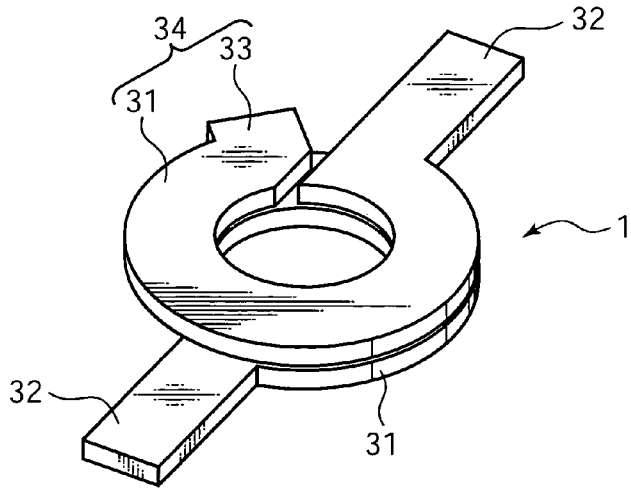
FIG. 5 is a perspective view of the coil shown in FIG. 4, showing a state after it is bent.
Figure 6:
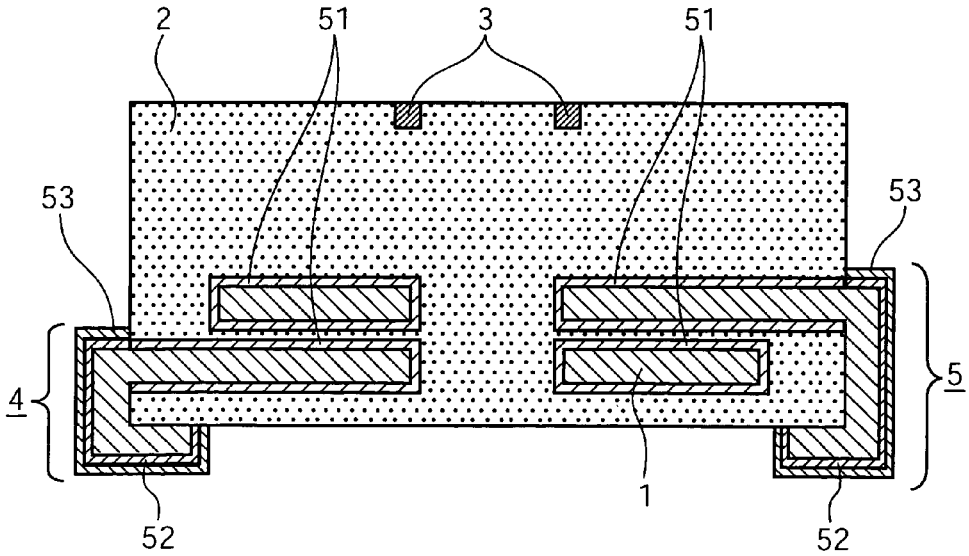
FIG. 6 is a sectional view of the inductance part shown in FIG. 1, as seen along section line I—I.

Next, the coil 1 and the like will be described in further detail. FIG. 4 is a plan view of a coil used in the inductance part shown in FIG. 1, showing a state before it is bent. FIG. 5 is a perspective view of the coil shown in FIG. 4, showing a state after it is bent. FIG. 6 is a sectional view of the inductance part, shown in FIG. 1, as seen along an I—I section line.

As shown in FIG. 4, a terminal-united coil before it is bent (or stamped-out flat plate) 1*a* is formed by processing a flat metal plate. The processing is conducted using a method such as laser cutting, etching and stamping-out, so that it is shaped as shown in the figure. It includes: two arc portions 31 which have a shape like a ring a part of which is cut off; two terminal portions 32 which extend from the two arc portions 31; and a connection portion 33 which connects the two arc portions 31. The flat metal plate which is a base material of the coil 1 is made of copper, silver or the like.

The stamped-out flat plate 1*a* is bent at the connection portion 33 (along the broken lines in FIG. 4) so that the central points of the two arc portions 31 overlap each other. Thus, the coil 1 shown in FIG. 5 can be obtained. At this time, a coil portion 34 is configured by the two arc portions 31 and the connection portion 33. As the input terminal 4 and the output terminal 5, the two terminal portions 32 radiate out. Herein, their radial center corresponds to the center of the coil portion 34. Hence, the terminal-united coil 1 is formed.

In this way, the coil portion 34 is configured by several such arc portions 31 and the connection portion 33 which connects the arc portions 31. This produces the coil 1 which has a coil shape, using a metal flat plate. In addition, the input terminal 4 and the output terminal 5 are united to the coil 1, thereby reducing the number of components of an inductance part.

Furthermore, an insulating film 51 (see FIG. 6) is formed on the surface of the arc portion 31, though it is not formed on the connection portion 33. Therefore, if the stamped-out flat plate 1*a* is bent, and the arc portions 31 overlap each other in the up-and-down directions, that prevents the two arc portions 31 from short-circuiting. In addition, the insulating film 51 is not formed on the connection portion 33, thus preventing the insulating film 51 from being broken when the connection portion 33 is bent. This keeps the coil 1 from deteriorating in the case where the insulating film 51 is torn.

Herein, the configuration of the coil 1 is not limited especially to the above described example, and thus, it can be diversely varied. Three or more arc portions may also be provided. In that case, the arc portions are each connected in sequence by connection portions, so that the number of turns becomes three or more. Besides, an intermediate tap may also be united therewith. In that case, the intermediate tap can also be united with a coil, thereby reducing the number of components of an inductance part. For example, as shown by a two-dot chain line in FIG. 4, an intermediate-tap united coil may also be used. Such an intermediate tap 32*a* extends from the arc portion 31. To produce it, from a flat metal plate, the plate which has that shape is stamped out, and then, is bent in the same way as described above.

As the magnetic body 2, a composite magnetic body can also be used which is made of metal magnetic powder and an insulating resin. Herein, soft magnetic alloy-powder is used as the metal magnetic powder, and a silicone resin is used as the insulating resin. The composite magnetic body is obtained by adding 3.3 weight percent of the silicone resin to the soft magnetic alloy-powder, mixing them, and passing them through a mesh to control the size of the particles. This composite magnetic body has a structure in which the silicone resin covers the particles of the soft magnetic alloy-powder, so that the magnetic body 2 has a superior insulating property.

As the soft magnetic alloy-powder, for example, Fe(50) Ni(50) soft magnetic alloy-powder can also be used which is produced by a water-atomizing method and has an average particle diameter of 13 μm. Herein, the material of the magnetic body 2 is not limited especially to the above described example. It may also be a composite of ferrite magnetic powder and an insulating resin, a composite of metal magnetic powder except this and an insulating resin, or not any composite but a ferrite magnetic material.

Figure 8A:
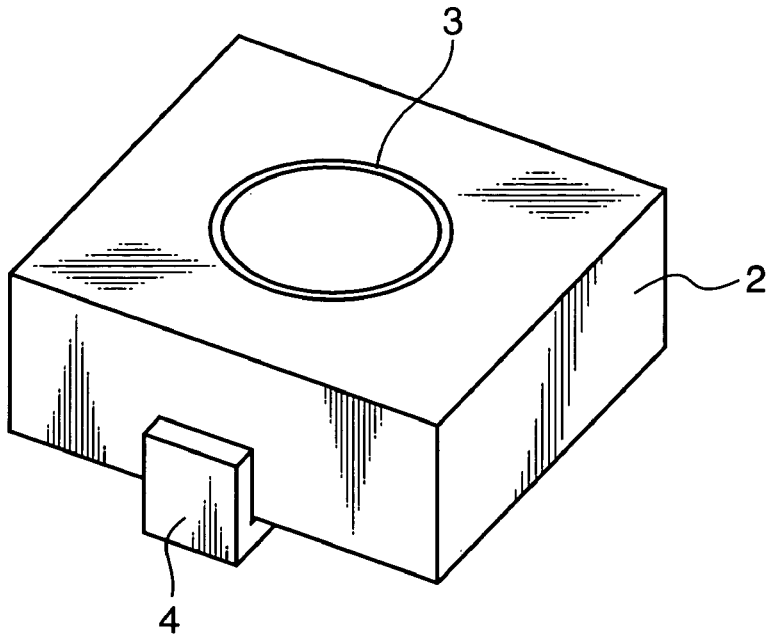
FIG. 8A is a perspective view of the inductance part shown in FIG. 1, showing mainly the external appearance of its upper surface.
Figure 8B:
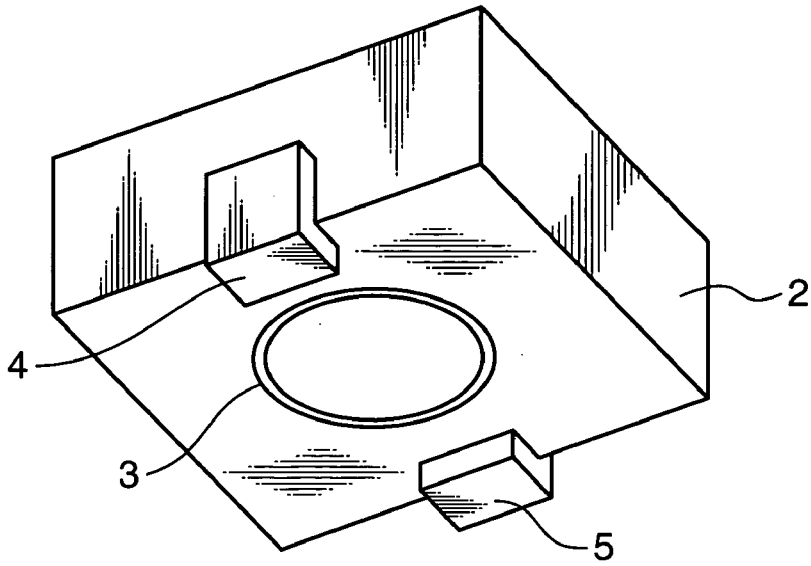
FIG. 8B is a perspective view of the inductance part shown in FIG. 1, showing mainly the external appearance of its lower surface.

As the short ring 3, a metal conductor such as copper and silver can be used. Such a metal conductor is generally superior in respect of heat-radiating properties to a magnetic material. This keeps the inductance part itself from generating heat. Herein, the location of the short ring 3 is not limited especially to the above described example. It may also be disposed in the lower surface of the magnetic body 2. In addition, as shown in FIG. 8A and FIG. 8B, the short rings 3 may also be disposed in both the upper surface and lower surface of the magnetic body 2. In this respect, the same is applied to the inductance parts according to the other embodiments.

As shown in FIG. 6, the input terminal 4 and the output terminal 5 are formed so as to extend from the side surface to the bottom surface of the magnetic body 2. In each of the input terminal 4 and the output terminal 5 formed in this way, an undercoat layer 52 is formed at the part which is exposed to the surface of the magnetic body 2. An uppermost layer 53 is formed to cover the undercoat layer 52. Preferably, an Ni layer is used as the undercoat layer 52, and a solder layer or an Sn layer is used as the uppermost layer 53.

For example, the internal diameter of the coil 1 is 4.2 mm; its external diameter, 7.9 mm; and the height, 1.7 mm. The magnetic body 2 is a rectangular parallelepiped 10 by 10 by 3.5 mm. The short ring 3 has an internal diameter of 4.2 mm; an external diameter of 4.3 mm; a height of 0.1 mm. Herein, the sizes of the coil 1, the magnetic body 2 and the short ring 3 are not limited especially to this example, and thus, they can be diversely varied.

Next, description will be given of a method of producing the above described inductance part. First, the material of the magnetic body 2 is put into a metallic mold to set the coil 1 therein. Then, the material of the magnetic body 2 is again put into the metallic mold to set the short ring 3 therein. Next, the material of the magnetic body 2 is further put into the metallic mold. Thereafter, a pressure of 3 ton/cm$^2$ is applied thereto, so that the coil 1, the magnetic body 2 and the short ring 3 are united and molded. Next, the inductance part is taken out of the metallic mold. Then, it is heated at 150° C. for about one hour, so that the magnetic body 2 is hardened. Thereafter, the input terminal 4 and the output terminal 5, which extend from the magnetic body 2, are bent along the surface from the side to the bottom of the magnetic body 2. Then, in each of the input terminal 4 and the output terminal 5, the undercoat layer 52 is formed at the part which is exposed to the surface of the magnetic body 2. The uppermost layer 53 is formed to cover the undercoat layer 52.

Next, an operation will be described of the inductance part produced as described above. When an electric current passes through such an inductance part, a magnetic flux is generated around the coil 1. As this magnetic flux, there is a magnetic flux which penetrates the center of the coil 1, or a magnetic flux which passes through the short ring 3 and leaks out of the magnetic body 2. When this leakage magnetic flux penetrates the short ring 3, an induced electromotive force is caused by the leakage magnetic flux. Thereby, in the reverse direction to the electric current which passes through the coil 1, an eddy current passes through the short ring 3.

Then, this eddy current generates a magnetic flux which crosses the short ring 3. Hence, the leakage magnetic flux and the crossing magnetic flux become in the reverse direction to each other, thereby negating each other. This prevents the magnetic flux generated around the coil 1 from leaking out of the magnetic body 2. Accordingly, it is shut up in the magnetic body 2, thus reducing the leakage magnetic flux sufficiently.

Furthermore, the coil 1 is produced by stamping out and bending a flat metal plate. Therefore, even if the inductance part is used within a high-frequency range, a sufficient inductance value and a low direct-current resistance value can be secured, compared with a wire-wound coil which is produced by winding a conductor. This allows the inductance part to operate at a large quantity of electric current. In addition, the coil 1 is configured by using a flat metal plate, thus realizing an inductance part which has a large percentage of the volume taken up by a coil.

Moreover, the insulating film 51 is formed on the arc portion 31 of the coil 1, and thereby, the part in which the coil portions 34 overlap each other is insulated. This allows the arc portions 31 to be piled up with no space between. In addition, the coil 1 is configured by using a flat metal plate, thus allowing a large quantity of electric current to pass through without increasing the number of turns of the coil 1. Hence, a sufficient inductance value can be secured. As a result, the height of the coil 1 can be kept at the required minimum, thereby realizing a smaller and lower profile inductance part.

Besides, the magnetic body 2 has a superior insulating property, thus preventing the coils or the coil portions 34 from short-circuiting or the like. This helps realize a reliable inductance part. In addition, when an electric current is sent to the inductance part, an eddy current which is generated in the magnetic body 2 can be depressed. This allows an inductance part to be realized which can be used within a higher-frequency range.

Furthermore, the short ring 3 is made of a metal conductor which has a superior heat-radiating property, thus realizing an inductance part which has a sufficient heat-radiating function.

Moreover, in each of the input terminal 4 and the output terminal 5, the undercoat layer 52 which is an Ni layer is formed, and on top of it, there is formed the uppermost layer 53 which is a solder layer or an Sn layer. Therefore, an inductance part can be realized which has a superior solderability and is reliable.

As described hereinbefore, the inductance part according to this embodiment is capable of reducing a leakage magnetic flux sufficiently, realizing a superior heat-radiating function, and operating at a high frequency and at a large quantity of electric current. Therefore, it can be desirably mounted in an electronic apparatus such as a notebook personal computer.

Figure 7:
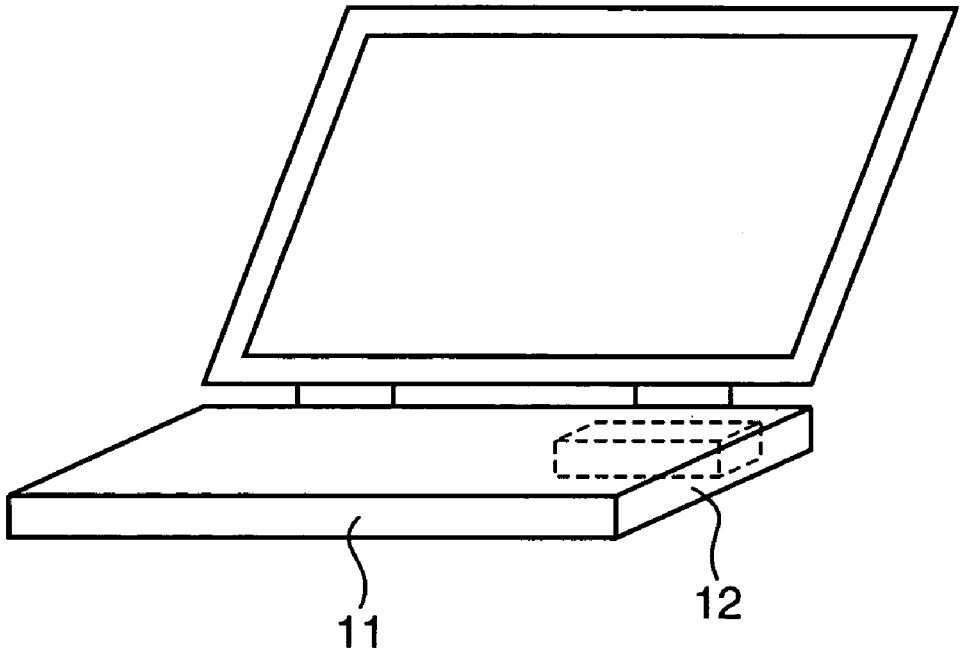
FIG. 7 is a perspective view of an electronic apparatus in which the inductance part shown in FIG. 1 is placed.

Next, an electronic apparatus will be described which houses the above described inductance part. FIG. 7 is a perspective view of an electronic apparatus in which the inductance part shown in FIG. 1 is placed. Herein, the electronic apparatus housing the inductance part according to the present invention is not limited especially to the following example. It can be applied in the same way to various electronic apparatuses.

As shown in FIG. 7, an electronic apparatus 11 is a notebook personal computer, and inside of it, a power supply circuit 12 is provided. The power supply circuit 12 is a switching-type power supply circuit which includes an AC/DC converter or the like in which the inductance part shown in FIG. 1 is used. It supplies power to a CPU. In this case, a leakage magnetic flux generated from the inductance part can be reduced, thereby preventing a high-frequency noise from adversely affecting peripheral apparatus, parts, or the like.

Furthermore, the short ring 3 is made of a metal conductor which has a superior heat-radiating property. Therefore, in the case where the inductance part shown in FIG. 1 is used in the power supply circuit 12 which supplies power to the CPU, even though the CPU generates a considerable quantity of heat, this inductance part can be desirably used because it has a sufficient heat-radiating function.

Moreover, the inductance part shown in FIG. 1 is an reliable inductance part which has a superior insulating property. Therefore, if the power supply circuit 12 is configured by using this inductance part, the insulation between it and other parts or the like can be sufficiently secured. This makes the electronic apparatus 11 more reliable.

In addition, the input terminal 4 and the output terminal 5 are bent to the lower surface of the magnetic body 2, and in the exposed part of each of the input terminal 4 and the output terminal 5, a solder layer or an Sn layer is formed. Therefore, the inductance part can be certainly mounted on a circuit substrate of the power supply circuit 12. This allows component parts to be densely attached, thus making the electronic apparatus itself smaller and thinner.

There is a case where an inductance part continues to be used in a state where at least one of the input terminal 4 and the output terminal 5 is inadequately attached to the substrate or the like. In that case, especially, the terminal may completely come off the circuit substrate. Sometimes, the inductance part may fall down, or the like, off the substrate or the like. However, the inductance part shown in FIG. 1 is an inductance part which has a superior solderability and is reliable. This avoids the above described disadvantage, thereby making the electronic apparatus more reliable.

Second Embodiment

Figure 9:
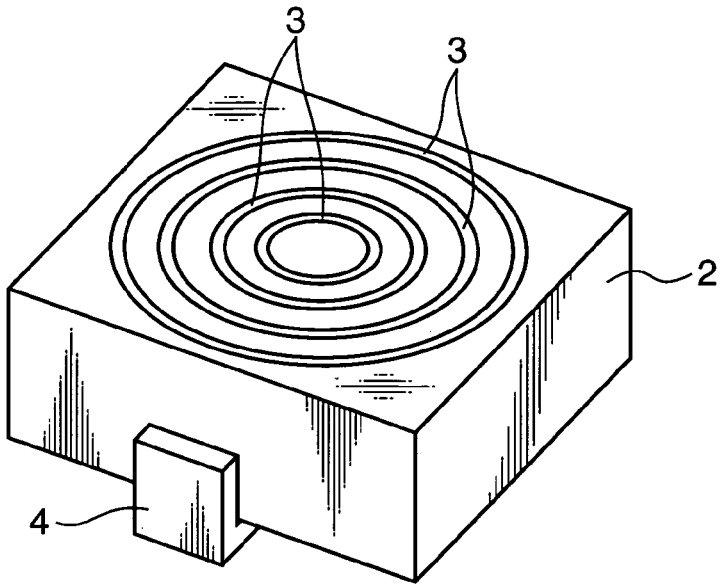
FIG. 9 is a perspective view of an inductance part according to a second embodiment of the present invention.
Figure 10:
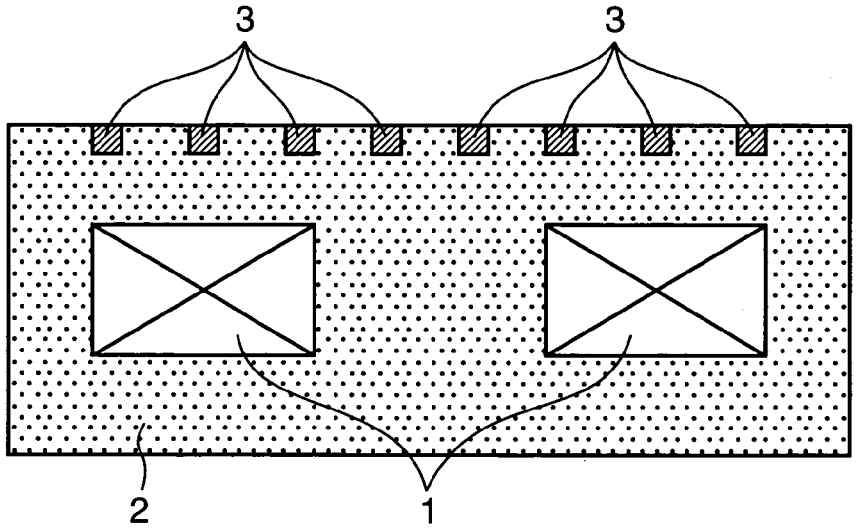
FIG. 10 is a schematic sectional view of the inductance part shown in FIG. 9.

Next, the inductance part according to a second embodiment of the present invention will be described with reference to FIG. 9 and FIG. 10. FIG. 9 is a perspective view of the inductance part according to the second embodiment of the present invention. FIG. 10 is a schematic sectional view of the inductance part shown in FIG. 9. A basic configuration of the inductance part shown in FIG. 9 and FIG. 10 is the same as the inductance part according to the first embodiment. However, the former is different from the latter, in respect of the number of short rings, specifically, it has more short rings.

In the inductance part shown in FIG. 9 and FIG. 10, in the upper surface of the magnetic body 2, four short rings 3 are disposed in the in-plane direction and concentrically with the coil 1. In this case, an eddy current which stems from a leakage magnetic flux passes through the four short rings 3, not just one. This allows the leakage magnetic flux to lessen further, and the inductance part to radiate heat more effectively. In addition, the upper-surface central part of the magnetic body 2 is in a position in which among the magnetic fluxes around the coil 1, a magnetic flux which is easy to leak is distributed. Several short rings 3 are disposed so as to surround the upper-surface central part, thus reducing the leakage magnetic flux further.

Furthermore, if a high-frequency current is sent to the inductance part, an eddy current which passes through the short rings 3 also becomes a high frequency. Hence, an eddy current passes near the surface of the short rings 3. Therefore, even if the short rings 3 are made thicker and wider, a sufficient effect cannot be obtained as a short ring. The depth range within which an eddy current passes through becomes, by a skin effect, for example, less than about 0.1 mm from the surface of the short rings 3. However, it depends upon a specific resistance value of the material used for the short rings 3 and a circuit driving frequency.

Accordingly, in the inductance part according to this embodiment, the shape of the short rings 3 is determined based on a used frequency, and in addition, four short rings 3 are provided. Thereby, each short ring 3 helps reduce a leakage magnetic flux, thus as a whole, reducing the leakage magnetic flux sufficiently.

Moreover, the several short rings 3 are made of a metal conductor such as copper and silver, thereby radiating heat more effectively. Herein, the number and location of the short rings 3 are not limited especially to the above described example, and thus, it can be diversely varied.

Third Embodiment

Figure 11:
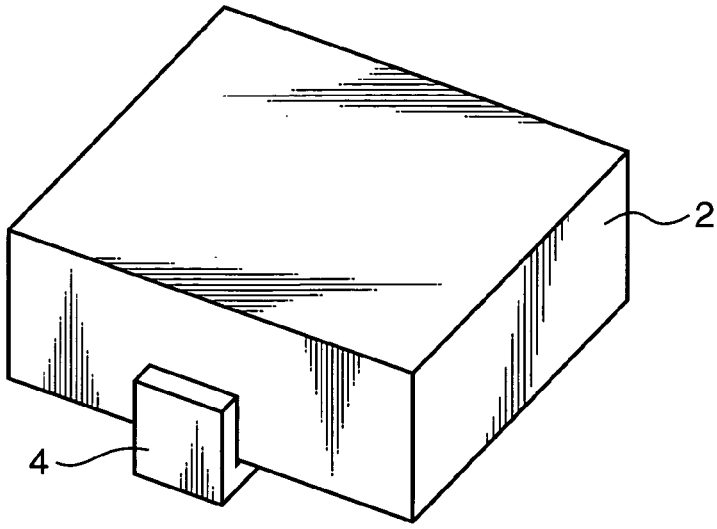
FIG. 11 is a perspective view of an inductance part according to a third embodiment of the present invention.
Figure 12:
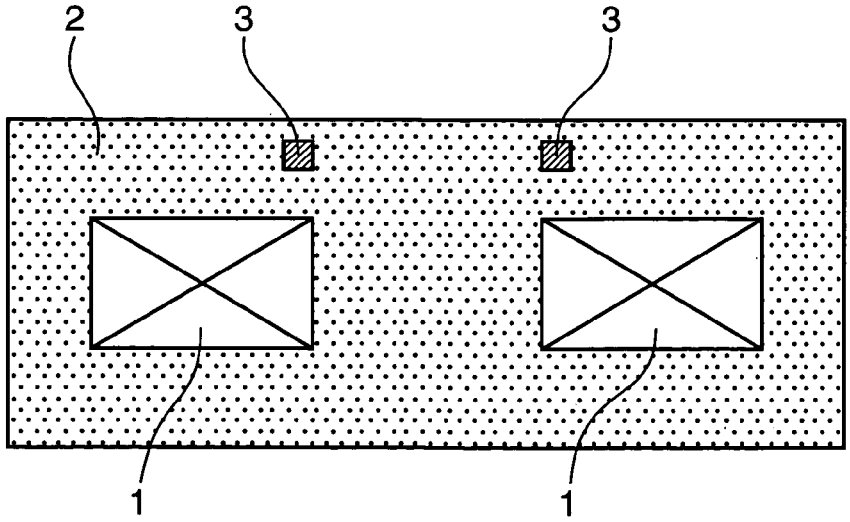
FIG. 12 is a schematic sectional view of the inductance part shown in FIG. 11.

Next, the inductance part according to a third embodiment of the present invention will be described with reference to FIG. 11 and FIG. 12. FIG. 11 is a perspective view of the inductance part according to the third embodiment of the present invention. FIG. 12 is a schematic sectional view of the inductance part shown in FIG. 11. A basic configuration of the inductance part shown in FIG. 11 and FIG. 12 is the same as the inductance part according to the first embodiment. However, the former is different from the latter with respect to the location of a short ring. Specifically, the short ring is buried in the magnetic body.

In the inductance part shown in FIG. 11 and FIG. 12, the short ring 3 is buried inside of the magnetic body 2. Herein, the closer a point of place around the coil 1 is to the coil 1, the stronger the magnetic flux around it becomes. Therefore, if the short ring 3 is not disposed in the surface of the magnetic body 2 but buried inside of the magnetic body 2, then the short ring 3 is supposed to be located at the part where the magnetic flux is stronger. This increases an eddy current which passes through the short ring 3, and also strengthens a crossing magnetic-flux which negates a leakage magnetic flux. Thereby, a leakage magnetic flux can be reduced further, and in addition, heat can be radiated more effectively.

Besides, the short ring 3 is buried in the magnetic body 2, and thus, there is no need to separately secure any space with the height necessary for disposing the short ring 3. This helps make an inductance part smaller and lower. In addition, the short ring 3 is not glued separately to the magnetic body 2, but buried therein. Therefore, in the process of manufacturing an inductance part, the gluing process can be omitted, thus reducing the number of assembly operations.

Fourth Embodiment

Figure 13:
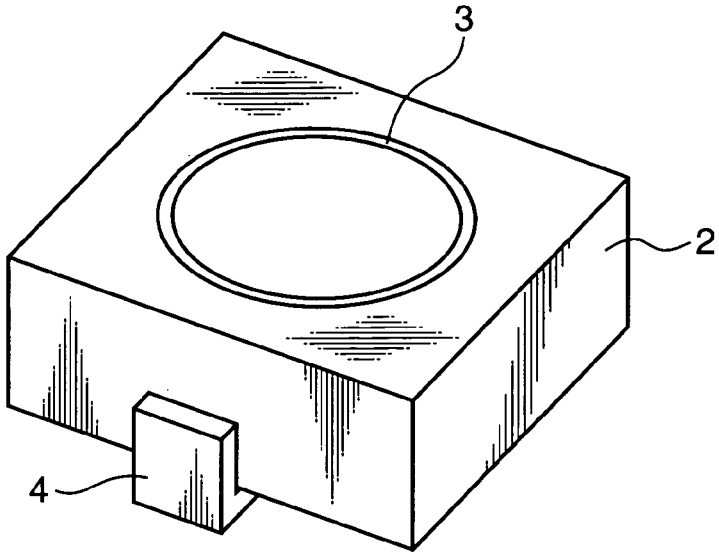
FIG. 13 is a perspective view of an inductance part according to a fourth embodiment of the present invention.
Figure 14:
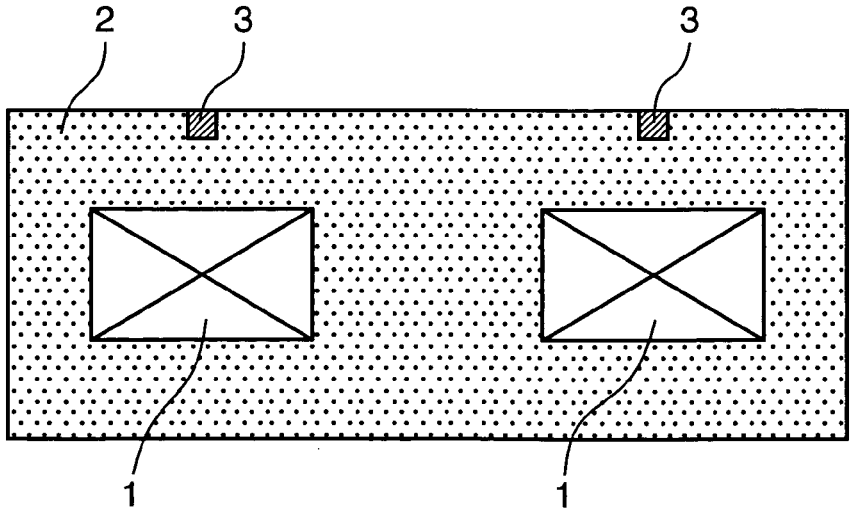
FIG. 14 is a schematic sectional view of the inductance part shown in FIG. 13.
Figure 15:
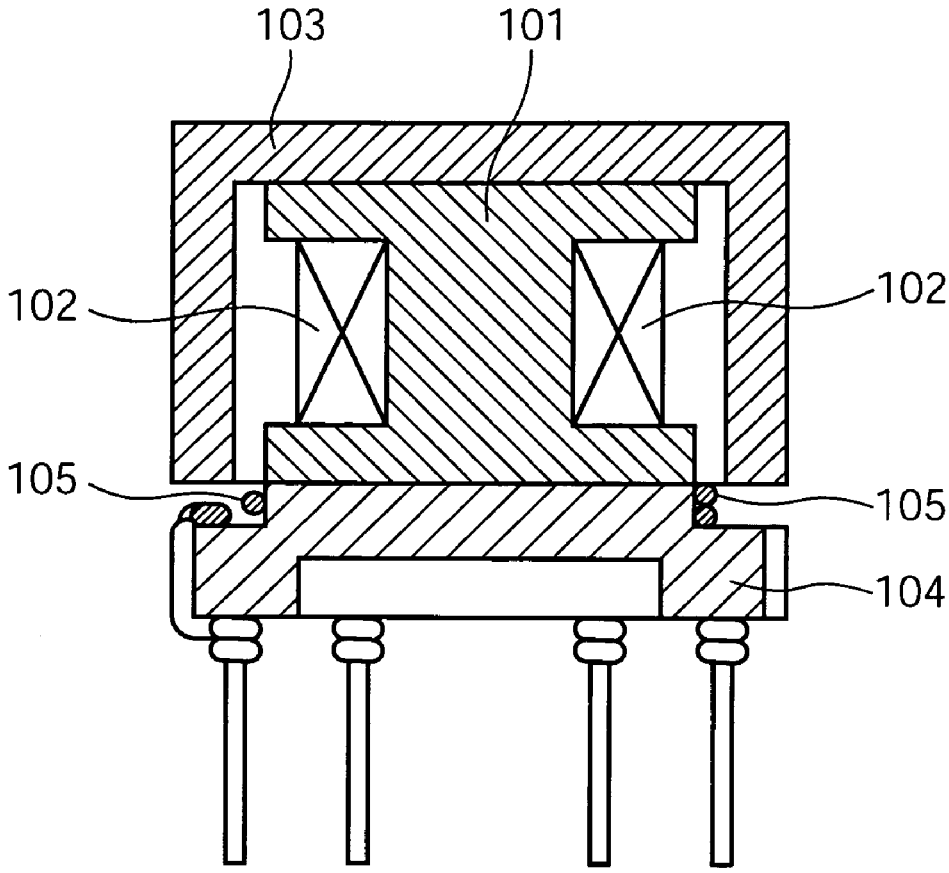
PRIOR ART FIG.15
FIG. 15 is a sectional view of a conventional inductance part.

Next, the inductance part according to a fourth embodiment of the present invention will be described with reference to FIG. 13 and FIG. 14. FIG. 13 is a perspective view of the inductance part according to the fourth embodiment of the present invention. FIG. 14 is a schematic sectional view of the inductance part shown in FIG. 13. A basic configuration of the inductance part shown in FIG. 13 and FIG. 14 is the same as the inductance part according to the first embodiment. However, the former is different from the latter with respect to the location of the short ring. Specifically, its short ring is located between the interior circumference and the exterior circumference of the coil.

In the inductance part shown in FIG. 13 and FIG. 14, the short ring 3 is located between the interior circumference and the exterior circumference of the coil 1. In addition, it is disposed at the upper part of the magnetic body 2, so that the upper surface of the short ring 3 is located on the same level with the upper surface of the magnetic body 2, and the short ring 3 is located concentrically with the coil 1. For example, the internal diameter of the short ring 3 is 6.0 mm; the external diameter is 6.1 mm; and the height is 0.1 mm.

Herein, a strong magnetic flux is distributed between the interior circumference and the exterior circumference of the coil 1 inside of the magnetic body 2. The short ring 3 is disposed so as to enclose this strong magnetic-flux range. This raises an eddy current which passes through the short ring 3, and also strengthens a crossing magnetic-flux which negates a leakage magnetic flux. Thereby, a leakage magnetic flux becomes weaker, and in addition, heat can be radiated more effectively.

This application is based on Japanese patent application serial No. 2003-163611, filed in Japan Patent Office on Jun. 9, 2003, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An inductance part, comprising:

a coil which is formed by bending a metal plate into a coil shape;

a magnetic body in which the coil is buried; and a short ring which faces the coil and is buried in the magnetic body so that a surface of the short ring is located on the same level with a surface of the magnetic body.

2. The inductance part according to claim 1, wherein the coil includes a plurality of arc portions, and a connection portion which connects the arc portions.

3. The inductance part according to claim 2, wherein the coil further includes two terminal portions which are united with the arc portions.

4. An inductance part, comprising:

a coil which is formed by bending a metal plate into a coil shape;

a magnetic body in which the coil is buried, wherein the coil includes a plurality of arc portions, and a connection portion that connects the arc portions, and the coil further includes two terminal portions that are united with the arc portion; and a short ring which faces the coil, wherein the coil further includes an intermediate tap which is united with at least one of the arc portions.

5. The inductance part according to claim 1, wherein as the short ring, a plurality of short rings are provided which face the coil in the magnetic body.

6. The inductance part according to claim 5, wherein the plurality of short rings are disposed in the in-plane direction of the magnetic body.

7. The inductance part according to claim 5, wherein the plurality of short rings are disposed concentrically with the coil.

8. The inductance part according to claim 1, wherein the short ring is located between the interior circumference and the exterior circumference of the coil.

9. The inductance part according to claim 1, wherein the magnetic body is made of at least one which is chosen from among a ferrite magnetic material, a composite of ferrite magnetic powder and an insulating resin, and a composite of metal magnetic powder and an insulating resin.

10. The inductance part according to claim 1, wherein the surface of the coil is processed so as to be insulated.

11. The inductance part according to claim 1, wherein:

the coil includes a plurality of arc portions, and a connection portion which connects the arc portions; and an insulating film is formed on at least one of the arc portions, but is not formed on the connection portion.

12. The inductance part according to claim 1, wherein:

the coil is formed of a sheet-metal member which is united with a terminal; and on the surface of the terminal, an Ni layer is formed at the part which is exposed outside of the magnetic body, and either of a solder layer and an Sn layer is formed on the Ni layer.

13. An electronic apparatus, comprising an inductance part which includes:

a coil which is formed by bending a metal plate into a coil shape;

a magnetic body in which the coil is buried; and a short ring which faces the coil and is buried in the magnetic body so that a surface of the short ring is located on the same level as a surface of the magnetic body.

* * * * *